US006690979B1

(12) United States Patent
Smith

(10) Patent No.: US 6,690,979 B1
(45) Date of Patent: Feb. 10, 2004

(54) INTELLIGENT APPLIANCE NETWORK

(75) Inventor: Robert M. Smith, Johnston, IA (US)

(73) Assignee: Maytag Corporation, Newton, IA (US)

( * ) Notice: Subject to any disclaimer, the term of this patent is extended or adjusted under 35 U.S.C. 154(b) by 422 days.

(21) Appl. No.: 09/699,497

(22) Filed: Oct. 31, 2000

(51) Int. Cl.[7] ..... H05B 6/68

(52) U.S. Cl. ..... 700/65; 700/17; 700/18; 219/702

(58) Field of Search ..... 700/11, 17, 18, 700/23, 65, 83; 219/702, 714; 340/825.22; 715/501.1, 513

(56) References Cited

U.S. PATENT DOCUMENTS

| | | | | | |
|---|---|---|---|---|---|
| 4,447,692 | A | * | 5/1984 | Mierzwinski | 219/10.55 B |
| 4,703,306 | A | | 10/1987 | Barritt | 340/310 CP |
| 4,812,963 | A | | 3/1989 | Albrecht et al. | 364/131 |
| 5,086,385 | A | * | 2/1992 | Launey et al. | 364/188 |
| 5,691,684 | A | | 11/1997 | Murrah | 235/385 |
| 5,715,555 | A | | 2/1998 | Reber et al. | 8/158 |
| 5,818,428 | A | | 10/1998 | Eisenbrandt et al. | 345/173 |
| 5,839,097 | A | | 11/1998 | Klausner | 702/188 |
| 5,909,183 | A | * | 6/1999 | Borgstahl et al. | 340/825.22 |
| 5,969,606 | A | | 10/1999 | Reber et al. | 340/540 |
| 5,970,469 | A | | 10/1999 | Scroggie et al. | 705/14 |
| 6,080,972 | A | * | 6/2000 | May | 219/494 |
| 6,121,593 | A | * | 9/2000 | Mansberry et al. | 219/679 |
| 6,133,847 | A | * | 10/2000 | Yang | 340/825.22 |
| 6,198,479 | B1 | * | 3/2001 | Humpleman et al. | 345/329 |
| 6,256,378 | B1 | * | 7/2001 | Iggulden et al. | 379/102.03 |
| 6,370,890 | B2 | * | 4/2002 | Roh et al. | 62/126 |
| 6,480,753 | B1 | * | 11/2002 | Calder et al. | 700/83 |

FOREIGN PATENT DOCUMENTS

| | | |
|---|---|---|
| EP | 0 837 599 | 4/1998 |
| JP | 4169773 | 6/1992 |
| JP | 9119768 | 5/1997 |
| JP | 10276478 | 10/1998 |

OTHER PUBLICATIONS

"The Ultimate Internet Appliance", *Wired News,* Kanney, Leander, 1994–99, Date unknown.

* cited by examiner

*Primary Examiner*—Emanuel Todd Voeltz
(74) *Attorney, Agent, or Firm*—Diederiks & Whitelaw, PLC

(57) ABSTRACT

A method of controlling an intelligent appliance network includes allowing a user to select a desired instruction sequence to be executed by a remote appliance. The instruction sequence contains commands to be completed by both the user and the appliance, as regulated by a CPU, with the sequence being paused when input is needed by the user and wherein the appliance commands are performed automatically. When applied to a cooking appliance, such as an oven, the appliance will automatically perform certain cooking functions according to a recipe being followed by a CPU. When applied to a washing machine, the factory set operating parameter of the machine can be altered to follow an instructed control sequence applicable to the task performed.

20 Claims, 3 Drawing Sheets

INTELLIGENT APPLIANCE NETWORK

BACKGROUND OF THE INVENTION

1. Field of the Invention

The present invention relates to a method of controlling an appliance network. Specifically, an appliance is indirectly connected to the Internet or other database(s) to download new instruction sequences for controlling the appliance. Each of the instruction sequences used with the invention includes directions for both the appliance and the user, such that a given sequence will direct the user to perform certain functions and, when required, causes the appliance to perform a specific task.

2. Discussion of the Prior Art

Most modern homes have more than one electric appliance. Many of those appliances are not automated at all. When a user wants to, for example, cook according to a recipe which requires more than one temperature setting, the user is forced to watch a clock and wait for an appropriate time to adjust the temperature setting of the cooking device. This may result in an imperfectly cooked food product, as the user may forget to alter the cooking temperature or may adjust it to the wrong temperature. In certain circumstances, strict adherence to a prescribed recipe may be required for a correct result.

Appliances with automatic settings were developed in an attempt to deal with this problem. Microwaves have since been developed which are pre-programmed with automatic cycles, such as meat defrost or popcorn cooking, in which the user need only insert the food to be cooked and press the appropriate keys (e.g., "Popcorn"). This has allowed users to better utilize their appliances with less worry. The user no longer needs to watch the appliance to make sure that he/she has the right recipe because the recipe is already programmed into the appliance. In addition, because the appliance is automatically controlled, problems associated with remembering to change the temperature or stop the cooking are eliminated as the appliance takes over such responsibilities. Although users could take advantage of programmed sequences to assist in cooking, each appliance requires its own controls with individualized programmed sequences as the various appliances were not interconnected.

U.S. Pat. No. 4,703,306 to Barritt addresses this problem by using a master controller to automatically control a number of closely located electric appliances. Appliances, such as ovens, washers, and dryers, are controlled via hardwired interface control units and a master controller. The master controller is programmed to monitor the status of the various appliances and automatically make adjustments as necessary. This allows control of each of the appliances from a central location and permits more than one appliance to be operated at a time. People could now regulate an entire kitchen or laundry room from a single control center. However, in order to complete this appliance center, the control panels associated with the individual appliances are removed in favor of a centralized control.

U.S. Pat. No. 5,839,097 to Klausner discloses a system which can give a user added flexibility of control over interconnected appliances via a central control computer. The central computer is designed to be inserted into a specially designed port on the face of each of the networked appliances. Although the control computer may have a small display and a keyboard, the control computer is essentially a remote actuator for the variety of appliances which may be attached to the network.

Each of the above disclosed systems exhibit at least one major drawback in that their memory is static. The appliances come from the factory installed with a set of programs. However, it is not possible for a user to edit or replace the existing programs. Although it may be possible to have a specialized technician service the appliance and upgrade the programs installed in the appliance, this would be a time consuming and expensive process. Therefore, users are locked into a single set of sequences as selected by the appliance manufacturer.

It is also possible to connect various household appliances to a database, usually housed within a central processing unit (CPU). In such a system, it is possible to upgrade the memory of the system by inputting new programs or sequences directly into the database. It is also known to connect the CPU to a computer network, such as the Internet or an intranet, for centralized control and to input new programs or sequences into the various appliances via the network. When a user selects a new program, the program can be electronically transmitted to a respective appliance and executed. Just as the "Popcorn" button is utilized in a microwave, the user then has the ability to select the new downloaded program to be executed by the appliance.

Although the above-discussed systems allow users to input new programs into appliances, another drawback remains. Each of the systems controls the appliances alone, without interaction by the user. Though the user is required to press a button or select the program in some other manner, that is usually the extent of involvement of the user. When the appliance begins the program, the user only waits until the program is completed. This restricts the programs to narrow commands which can be performed by the appliance itself.

SUMMARY OF THE INVENTION

The present invention is directed to a system designed to enable an efficient interaction between a user and an appliance. This invention requires instruction sequences which are more developed than simple programs. Previous programs used with appliances have essentially been a series of commands which are interpreted and executed by an automated machine, without much interaction from a human user. The method of the invention requires human interaction with the appliances.

The network of the invention basically includes a CPU which is interconnected to at least one appliance via an electronic network. In order to utilize the network of the invention, an instruction sequence is required. The instruction sequence includes directions for both the appliance and the user. Before the instruction sequence is executed, a display is used to show the user what will be accomplished during the selected program. When the sequence begins, the CPU determines if the particular command is directed to the appliance or the user. If the command is an appliance command, the CPU automatically causes the appliance to perform the command. If, however, the command requires human performance, the CPU alerts the user and conveys the command to be performed. This allows more complex programs and sequences than with known programmable appliances.

Although the appliances to be used with the invention will often come programmed with certain instruction sequences, it is possible to acquire and use instruction sequences not provided with the machine. Because the appliance is preferably connected to a computer network, the user can input new instruction sequences into the CPU as desired. In addition, the CPU can have an Internet or other network connection, whereby additional instruction sequences may be downloaded into the CPU or simply, directly executed.

Additional objects, features and advantages of the invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENTS

Figure 1:
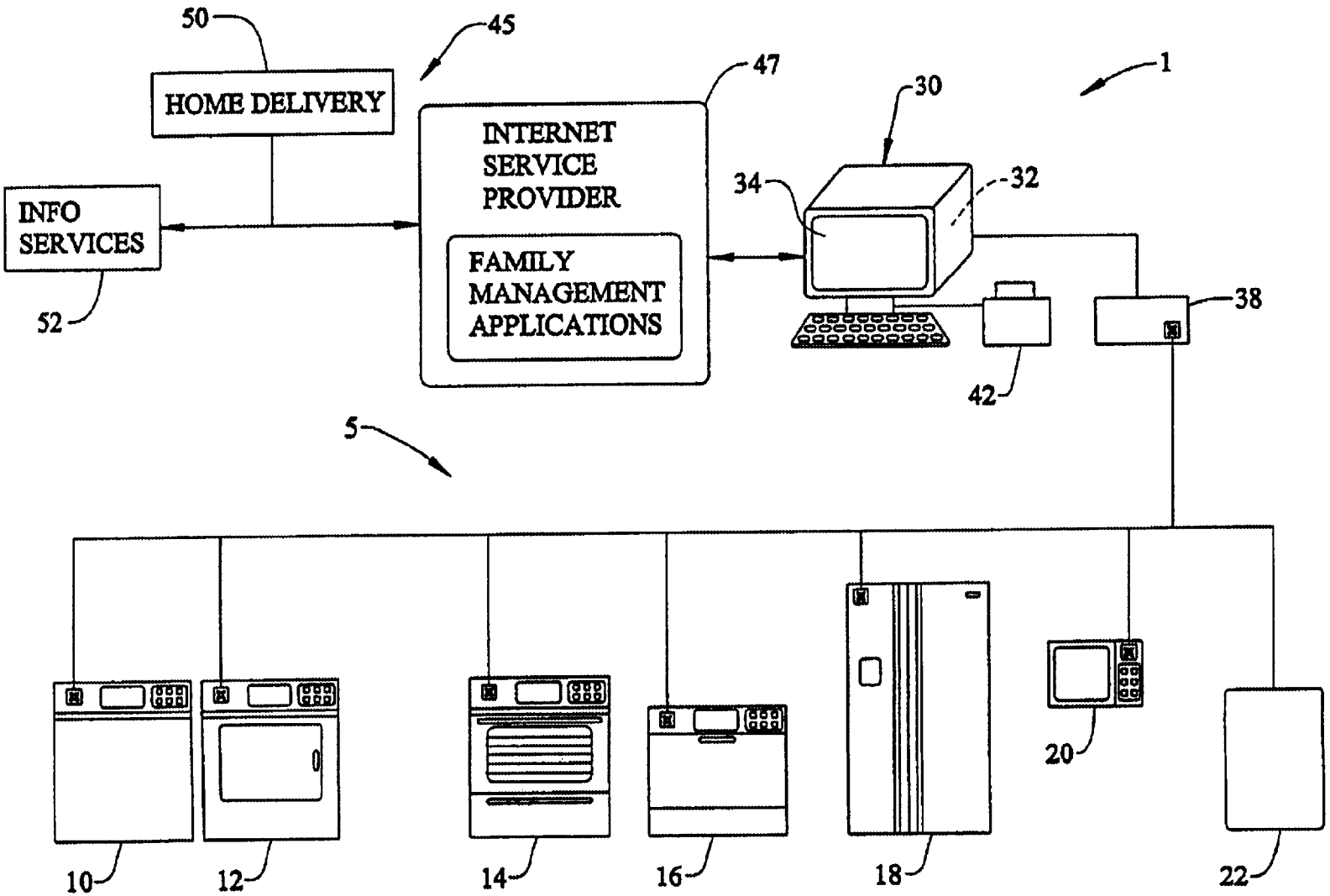
FIG. 1 diagrammatically depicts an appliance network constructed in accordance with the invention.

FIG. 1 depicts a network 1 arranged in accordance with the present invention. Specifically, network 1 includes an array of appliances 5, such as a washing machine 10, a dryer 12, an oven 14, a dishwasher 16, a refrigerator 18, a microwave 20, and a generic representation for another appliance 22. The other appliance 22 may be constituted by a trash compactor, mixer, or any other household or commercial appliance. Although the network 1 is shown with a plurality of specific appliances 5, it is within the scope of this invention to vary the type and number of appliances used.

Attached to the appliances 5 is a computer 30. The computer 30 is preferably constituted by a common home computer including a CPU 32, memory (not shown), a display 34, and a modem (not shown) or other network device for accessing external databases. Although computer 30 is used in the network 1 and is connected to the appliances 5, it may also be used for normal computing applications, such as web browsing or word processing, because the invention may be used with a standard home computer operating under a specified program. The only distinction between a normal home computer and the computer 30 used with this invention is the presence of an appliance control node 38. The appliance control node 38 serves as the connection and bus between the appliances 5 and the computer 30. It is the appliance control node 38 which is directly connected to the various appliances 5, not the computer 30 itself. This allows greater expandability of the network 1 for addition of appliances 5. The connection between the appliances 5 and the computer 30, through the appliance control node 38, is bi-directional, which allows data to pass from the computer 30 to the appliances 5, as well as from the appliances 5 to the computer 30. The appliance control node 38 is similar to a common computer networking hub or router and functions as a repeater to broadcast inputs to the various devices connected to it. Also shown in FIG. 1 is a printer 42 which allows a user to print, not only instruction sequences used with the network 1, but anything a typical computer can print.

While the CPU 32 is preferably integrated into computer 30, it is within the scope of the invention to integrate the CPU 32 and display 34 into one of the appliances 5, thus eliminating the separate computer 30 and appliance control node 38, while providing one or more input buttons or a touch screen for the user. In such a network, it is possible to connect the various appliances to one central appliance, or to even have a single appliance on the network 1.

The network 1 shown in FIG. 1 additionally depicts computer 30 connected to an external network 45. Although this may be a straight direct dial-up connection to a remote computer system, it may also be connected to the Internet via an Internet Service Provider (ISP) 47, which can be accessed by the computer 30 through the modem, or other Internet access means. Through the external network 45, the user has the ability to order a wide range of products and services, such as by linking with a home delivery system 50. The instruction sequences used with this invention are preferably displayed on the computer 30 before being executed such that the user has the ability to determine if any of the required elements are needed. For example, if the instruction sequence is directed to cooking, the user can determine that all necessary ingredients, such as milk, flour or a specific spice are readily available. If one or more ingredients are needed, the user can order any required ingredients through the home delivery system 50 which is accessed via the external network 45.

Also accessed through the external network 45 are information services 52. These information services 52 are often standard Internet web sites which contain various types of information. The information services 52 to be used with the invention may contain instruction sequences which can be downloaded to the computer 30 and stored in memory or immediately executed. This gives the user the unlimited ability to select new instruction sequences to be executed by the network 1. When a user finds a new instruction sequence desired to be either downloaded to the memory or immediately executed, the user need only select the specific instruction sequence from the information service 52, and instructs the computer 30 to either execute or save to memory. By saving to memory, the user can execute the instruction sequence at a later date. It is also possible to save instruction sequences as they are downloaded to develop a library to be archived for later use. Because the user has the ability to save instruction sequences, the external network 45 need not be accessed each time it is desired to execute an instruction sequence. Instead, an instruction sequence can be selected from memory of computer 30 and executed in the same manner as if selecting the instruction sequence was received from the external network 45. Thus, the external network 45 is not required for execution of any given instruction sequence.

Figure 2:
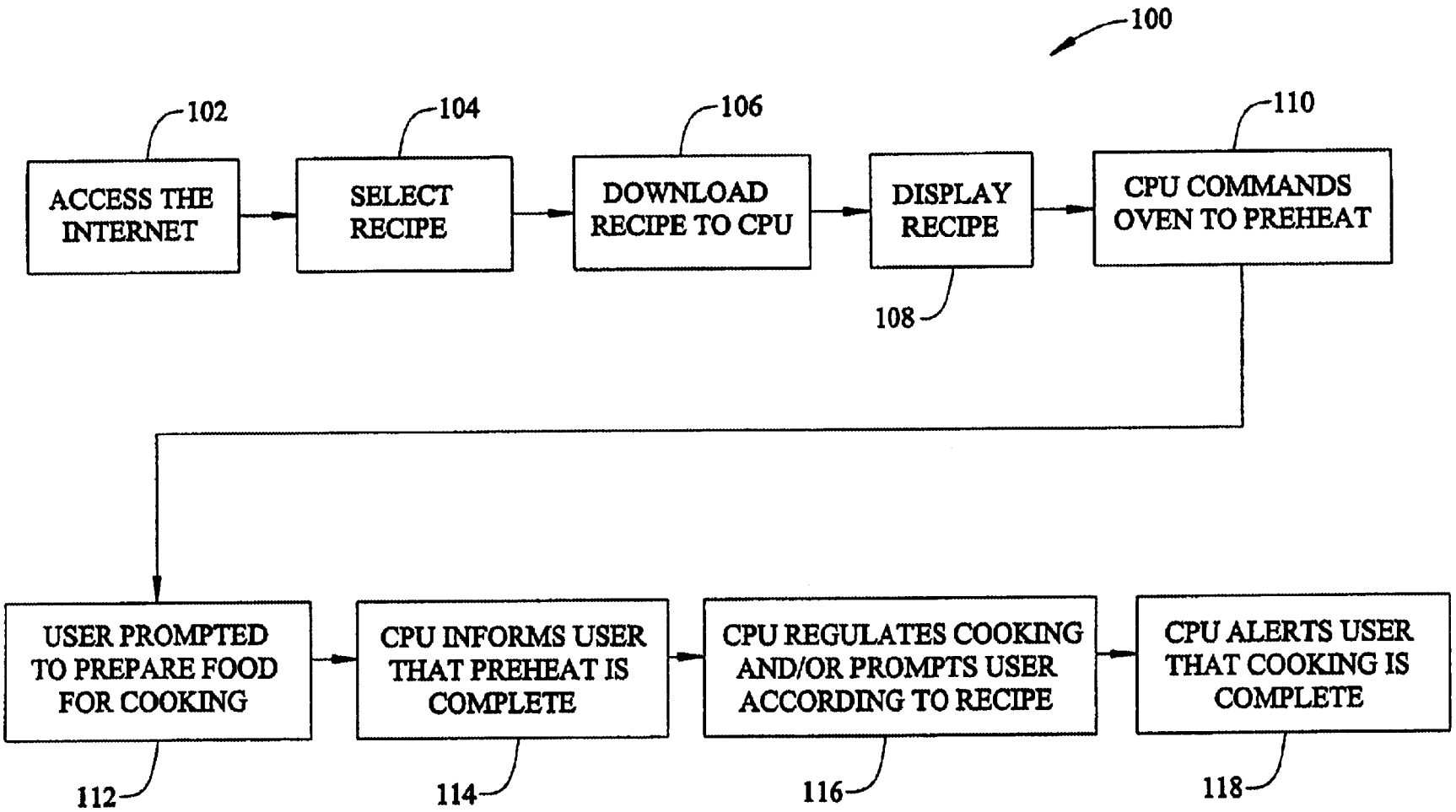
FIG. 2 represents a flow chart of a cooking scenario in accordance with the invention.
Figure 3:
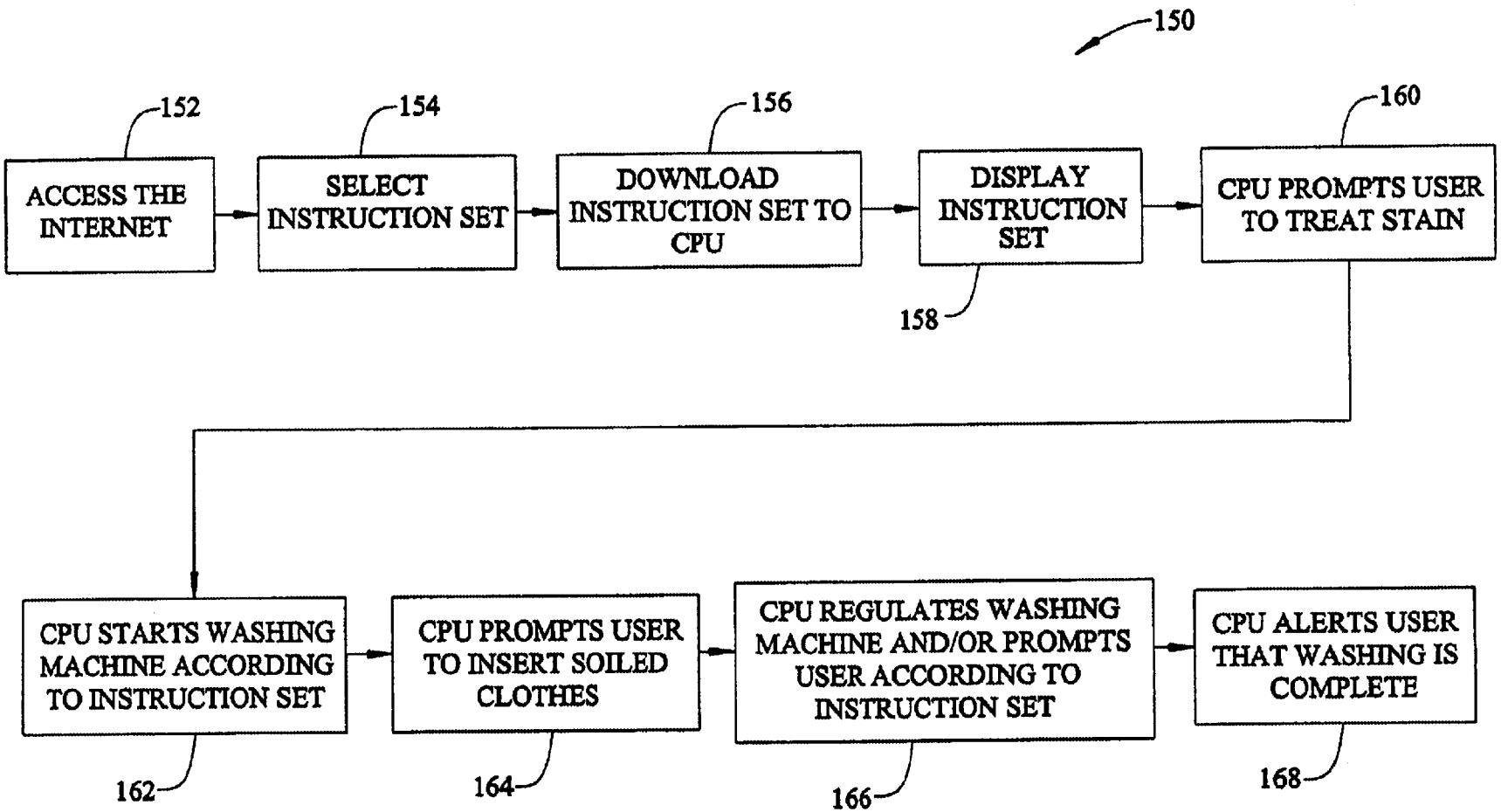
FIG. 3 represents a flow chart of a clothes washing scenario in accordance with the invention.

As indicated above, the instruction sequences used with the invention direct both the user and the appliance, as diagrammed in FIGS. 2 and 3. By giving commands both to the user and the appliance 5, the range of tasks which can be completed is greatly increased, because the appliance 5 need not be pre-programmed with all of the execution steps. Preferably, each command contains both the actual instruction and an identity tag which identifies the correct component. When the instruction sequence is executed, the computer 30 directs the corresponding component, an appliance 5 or the user, to complete the instruction. When a specific command is reached, the computer 30, through the CPU 32, must determine if the command is to be completed by the user or by an appliance 5. If it is to be competed by the user, the computer 30 alerts the user as to the existence of the command and instructs the user what to do through the display 34. The computer 30 can be programmed to give the user a predetermined amount of time before moving to the next command, or pause until directed to continue by the user (such as by depressing an "ENTER" button). If, however, the command is to be completed by an appliance 5, the computer 30 first determines which appliance 5, and then sends the command to the correct appliance 5, via the network 1, for automatic execution. The final command of each instruction sequence is to alert the user that the instruction sequence is complete, which can be quite simple as proceeding to a subsequent step in the sequence.

Because the network 1 is bi-directional, the commands preferably utilize various sensors which are incorporated in the appliances 5. For example, a thermistor in the dryer 12 may be used to detect an internal operating temperature reported back to the computer 30 for regulation. The bi-directional nature of the network 1 additionally allows for error detection and notification, e.g., if the CPU 32 attempts to operate microwave 20 while it is open, the microwave 20 can send an error message to the computer 30, which can then alert the user to close the microwave. If a washing machine 10 with an automatic detergent dispenser is used, when the detergent dispenser is empty, the washing machine 10 can alert the computer 30 of the condition. The computer 30 can even be programmed to automatically connect to the home delivery services 50 to have more detergent delivered.

FIG. 2 depicts an exemplary cooking procedure 100 in accordance with the invention. In such a scenario, the instruction sequence used is a recipe with cooking instructions. In Step 102, the user accesses the Internet to search for a recipe available from an information service 52. This can be accomplished through the ISP 47 or another known Internet access method. Once the recipe is located, the user selects the recipe in Step 104. In this scenario, the user wishes to immediately execute the instruction sequence and informs the CPU 32 when the recipe is selected. Selection of the recipe starts the download of the entire recipe to the CPU 32 at Step 106. In Step 108, the recipe is displayed by the computer 30 for review by the user. This gives the user the opportunity to review the recipe to determine if all of the ingredients are present and to make sure this is the correct recipe before beginning the instruction sequence. The CPU 32 reads the first command and accordingly, in Step 110, automatically preheats oven 14. Because the second command is to be completed by the user, in Step 112, the CPU 32 alerts the user and presents instructions through the display 34 of the need to prepare the food for cooking. Usually this entails mixing the ingredients, but may be any food preparation procedure to be performed by a user. When the oven 14 reaches its preheat temperature, the CPU 32 is notified through a suitable sensor (not shown). In Step 114, the CPU 32 informs the user that the preheat step 110 is complete and that it is time to place the food prepared in Step 112 into the oven 14. Thereafter, the CPU 32 regulates the cooking by giving commands to either the oven 14 or to the user according to the remaining instructions recipe, in Step 116. When the final command is reached in Step 118, CPU 32 alerts the user that the instruction sequence, hence the cooking operation, is complete.

FIG. 3 depicts an exemplary clothes washing procedure performed in accordance with the invention. More specifically, FIG. 3 represents a flow chart of the steps of a typical cleaning procedure 150 in accordance with the invention. Many of the steps of cleaning procedure 150 are similar to steps of the cooking procedure 100, but the appliance 5 used is washing machine 10 instead of oven 14. In this example, a user is confronted with a new stain. Accordingly, the Internet is accessed to search various information services 52 for an instruction sequence directed to treating the particular the specific stain on the specific fabric in Step 152. Just as in the cooking procedure 100, this procedure can be accomplished through the ISP 47 or any other Internet access method. Once a new instruction sequence is located on the Internet, it is selected for execution, in Step 154. Of course, it is possible that a program can be uploaded from a disc or the like as well. In any event, the instruction sequence is loaded on the computer 30 in Step 156. In Step 158, the instruction sequence is displayed for evaluation by the user. This gives the user the opportunity to review the instruction sequence again before its performance. Of course, this step could be skipped. Because the first command in this instruction sequence is to be executed by the user, the CPU 32 only displays the command. The CPU 32 then either waits for verification that the command has been executed or can simply give the user a certain time to complete the task Step 160.

In Step 162, the CPU 32 starts the washing machine 10 according to the instruction set, such as by dispensing detergent and starting the water filling process. Because Step 164 requires user intervention, the CPU 32 alerts the user and prompts to pretreat and then load the soiled clothes. In Step 166, the CPU 32 regulates the washing procedure 150 by giving instructions to either or both the washing machine 10 or the user according to the remaining commands of the instruction sequence (Step 166). The regulation of the washing machine 10 will usually regulate at least one washing parameter. Normal parameters include, but are not limited to, wash time, wash temperature, rinse time, rinse temperature, spin speed, spin duration, time of application of fabric softener and/or bleach, supplemental detergent dispensing, time of detergent application, and total sequence duration. Commands sent by the CPU 32 to the washing machine 10 may change one or more of the washing parameters. When the washing machine 10 completes the final command of the instruction sequence, the CPU 32, alerts the user that the washing procedure 150 is complete. Because a dryer 12 is preferably also part of network 1, the instruction set may include commands which relate to the dryer 12 once the commands relating to the washing machine 10 are complete.

Although described with reference to preferred embodiments, it should readily understood that various changes and/or modifications could be made to the invention without departing from the spirit thereof. For instance, although FIGS. 2 and 3 depict instruction sequences for cooking and clothes washing procedures respectively, analogous instruction sequences may be utilized to control procedures in various appliances 5. In addition, although described with relation to the Internet, it is also within the scope of the invention to use any means to load the instruction sequences into the CPU 32, e.g. removable memory devices, other remote networks, user scripted instruction sequences, manual keyboard input, etc. In any event, the invention is only intended to be limited by the scope of the following claims.

I claim:

1. A method of controlling an operation of an appliance comprising:

providing a central processing unit (CPU);

providing at least one appliance remote from said CPU;

electrically connecting the at least one appliance to said CPU;

loading an instruction sequence into said CPU, wherein said instruction sequence includes first and second sets of commands, with said first set of commands being directed to a user of the appliance and said second set of commands being directed to the appliance; and transmitting said second set of commands to said appliance during the performance of said instruction sequence.

2. The method according to claim 1, further comprising:

controlling said CPU, interpreting said instruction sequence and directing said appliance in accordance with said instruction sequence.

3. The method according to claim 1, further comprising:

connecting said CPU to the Internet;

accessing a remote database for the instruction sequences; and downloading said instruction sequence via the Internet.

4. The method, according to claim 1, wherein said appliance constitutes a cooking unit and said instruction sequence comprises a recipe, wherein said recipe includes at least one cooking step.

5. The method according to claim 4, further comprising;

connecting said CPU to the Internet;

accessing a remote database of instruction sequences; and downloading said instruction sequence via the Internet.

6. The method according to claim 5, wherein said cooking unit constitutes an oven.

7. The method according to claim 6, wherein said recipe comprises a step for automatically turning on said oven.

8. The method according to claim 7, wherein said recipe comprises a step for automatically preheating said oven.

9. The method according to claim 6, wherein said recipe comprises steps for:

creating an uncooked mixture of ingredients;

inserting said mixture in said oven;

controlling said oven; and removing said mixture from said oven.

10. The method according to claim 9, wherein said recipe further comprises: a step of preheating said oven.

11. The method according to claim 1, wherein said appliance constitutes a washing unit and said instruction sequence comprises at least one step for washing an article in the appliance.

12. The method according to claim 11, wherein said washing unit constitutes a clothes washing machine.

13. The method according to claim 12, further comprising:

connecting said CPU to the Internet;

accessing a remote database of instruction sequences; and downloading said instruction sequence via the Internet.

14. The method according to claim 13, wherein said second set of commands comprises: a step for automatically filling said washing machine.

15. The method according to claim 14, wherein said second set of commands comprises a step for controlling at least one parameter of the operation of said washing machine.

16. The method according to claim 15, wherein said at least one parameter is selected from the group consisting of wash time, wash temperature, rinse time, rinse temperature, spin speed, spin duration, time of fabric softener and/or application, supplemental detergent dispensing, time of detergent application, and total sequence duration.

17. The method according to claim 1, wherein said instruction sequence includes at least one command of said first set of commands following at least one command of said second set of commands.

18. An appliance control system comprising:

means for loading an instruction sequence into a storage unit, wherein said instruction sequence includes first and second sets of commands with the first set of commands being directed to a user of an appliance, which is located remote from the storage unit, and the second set of commands being directed to the appliance; and means for automatically transmitting said second set of commands to said appliance during performance of said instruction sequence.

19. The control system as in claim 18, wherein said appliance is an oven and said instruction sequence includes a command for preheating said oven.

20. The control system as in claim 18, wherein the appliance is a washing machine and said instruction sequence includes a command for altering a washing parameter of said washing machine.

* * * * *